US005520962A

United States Patent [19]

Jones, Jr.

[11] Patent Number: 5,520,962

[45] Date of Patent: May 28, 1996

[54] METHOD AND COMPOSITION FOR INCREASING REPELLENCY ON CARPET AND CARPET YARN

[75] Inventor: Dennis J. Jones, Jr., Dalton, Ga.

[73] Assignee: Shaw Industries, Inc., Dalton, Ga.

[21] Appl. No.: 388,033

[22] Filed: Feb. 13, 1995

[51] Int. Cl.[6] ..... B05D 3/02

[52] U.S. Cl. ..... 427/393.4; 8/115.56; 8/115.64; 427/430.1; 428/96; 524/539; 524/544; 524/599; 524/805

[58] Field of Search ..... 8/115.51, 115.54, 8/115.6, 115.56, 115.64; 427/393.4, 430.1; 428/96; 524/539, 544, 599, 805

[56] References Cited

U.S. PATENT DOCUMENTS

| | | | |
|---|---|---|---|
| 1,901,536 | 3/1933 | Schafer | 528/150 |
| 1,972,754 | 9/1934 | Biedermann | 528/150 |
| 1,988,985 | 1/1935 | Schafer | 528/150 |
| 2,036,161 | 3/1936 | Schuette | 528/150 |
| 2,112,361 | 3/1938 | Fischer | 528/150 |
| 2,171,806 | 9/1939 | Russell et al. | 528/150 |
| 2,581,390 | 1/1952 | Groote | 525/502 |
| 3,221,079 | 11/1965 | Harris | 528/150 |
| 3,433,666 | 3/1969 | Moyse | 117/139.5 |
| 3,650,801 | 3/1972 | Hinton, Jr. et al. | 117/47 A |
| 3,824,125 | 7/1974 | Hinton, Jr. et al. | 8/491.6 |
| 3,843,576 | 10/1974 | Parkinson | 260/29.3 |
| 3,849,162 | 11/1974 | Meuller et al. | 8/156 |
| 3,949,124 | 4/1976 | Jilla | 428/96 |
| 4,501,591 | 2/1985 | Ucci et al. | 8/495 |
| 4,592,940 | 6/1986 | Blyth et al. | 428/96 |
| 4,680,212 | 7/1987 | Blyth et al. | 428/97 |
| 4,780,099 | 10/1988 | Greschler et al. | 8/115.6 |
| 4,822,373 | 4/1989 | Olson et al. | 8/115.6 |
| 4,839,212 | 6/1989 | Blyth et al. | 428/96 |
| 4,857,392 | 8/1989 | Kirjanov et al. | 428/267 |
| 4,865,885 | 9/1989 | Herlant et al. | 427/322 |
| 4,875,901 | 10/1989 | Payet et al. | 8/115.56 |
| 4,877,538 | 10/1989 | Kirjanov et al. | 252/8.7 |
| 4,937,123 | 6/1990 | Chang et al. | 8/115.6 X |
| 5,073,442 | 12/1991 | Knowlton et al. | 428/267 |
| 5,084,306 | 1/1992 | McLellan et al. | 427/393.4 |
| 5,219,620 | 6/1993 | Potter et al. | 427/434.2 |
| 5,310,828 | 5/1994 | Williams et al. | 8/115.51 X |
| 5,366,161 | 11/1994 | Potter et al. | 239/455 |

FOREIGN PATENT DOCUMENTS

| | | |
|---|---|---|
| 0235980A1 | 9/1987 | European Pat. Off. . |
| 0267681A2 | 5/1988 | European Pat. Off. . |
| 0268374A2 | 5/1988 | European Pat. Off. . |
| 0328822A2 | 8/1989 | European Pat. Off. . |
| 0329899A2 | 8/1989 | European Pat. Off. . |

OTHER PUBLICATIONS

Greschler, Imrich, "Stain–Resistant Polyamide Fibers with Resistance to Yellowing by Nitrogen Dioxide", *Chemical Abstracts,* vol. 108, No. 2, 1988, p. 72.

Jose, D. J., "Stain Resistant Carpets", *Textile Journal,* Nov. 1988.

Liss, Theodor Arthur, "Stain and Yellowing–Resistant Polyamide Fabrics", *Chemical Abstracts,* vol. 108, No. 6, Feb. 1988, p. 86.

Shima, Tsukasa, "Antistatic, Stain–Resistant Polyester Textiles", *Chemical Abstracts,* vol. 81, Jul. 1974, p. 72.

Anton, Anthony, "Polyamide Fiber Reactive Chemical Treatments For Differential Dyeability", —, vol. 13, No. 2, 1981, pp. 31–35.

Carr, J., "Nylon and the Carpet Industry", *Textile Horizons,* Jun. 1988, pp. 43–45.

Lipson, M., "Use of Polymers to Immunize Wool Against Acid Dyes", *Nature,* Jun. 1, 1946, vol. 57.

"Leukotan Acrylic Syntans Product Summary", *Rohm and Haas Leather Chemicals,* Rohm and Haas Company, 1985.

Porter, Raymond, "Acrylic Syntans For Retanning Leather", *Leather,* Sep. 1969, pp. 93–95, 101.

Shortland, F. J. D., "The Role of Acrylics in Wet Processing", *Journal of the Society of Leather Technologists and Chemists,* vol. 64, No. 3, May–Jun. 1980, p. 60.

"Leukotan 970 Acrylic Syntan", *Rohm and Haas Leather Chemicals,* Rohm and Haas Company, 1984.

"Retan 540", *Rohm and Haas Leather Chemicals,* Rohm and Haas Company, 1981.

*Primary Examiner*—Michael Lusignan

*Attorney, Agent, or Firm*—Willian Brinks Hofer Gilson & Lione

[57] ABSTRACT

The invention is directed to a method and composition for treating carpet yarn and carpet to thereby enhance its repellency, and preferably to enhance its stain resistance as well. In one aspect of the invention, the method includes the steps of providing a carpet yarn comprising polymeric fibers. An anionic or nonionic fluorochemical compound is provided in an aqueous medium, the aqueous medium having a pH below about 3.5. The carpet yarn is immersed in the aqueous medium. The carpet yarn and aqueous medium are heated after which excess water is removed from the carpet yarn. The aqueous medium preferably also includes an anionic binding compound that acts to impart stain resistance to the yarn.

67 Claims, No Drawings

METHOD AND COMPOSITION FOR INCREASING REPELLENCY ON CARPET AND CARPET YARN

BACKGROUND OF THE INVENTION

The present invention relates to the field of carpet manufacture, and more particularly relates to methods of treating carpet or carpet yarn to enhance its repellency and, preferably, to enhance its stain resistance also.

In the last two decades, there has been considerable interest in developing treatments for carpet fibers, particularly nylon carpet fibers, to enhance repellency and stain resistance. For example, it is now a common practice to topically apply a compound from the class known as fluorochemicals. The object of applying such fluorochemicals is to reduce the tendency of soil, oil and/or water to adhere to the carpet fibers. In addition to soil, the fluorochemicals can also reduce the tendency of oil and/or water to adhere to the carpet fibers. It is also a common practice to apply a stain resist compound to nylon carpet to make the nylon carpet fibers resistant to staining, particularly by anionic or "acid" dyes. The mechanism for stain resist compounds is believed to involve blocking of the dye sites on the nylon polymer.

The fluorochemicals include a fluorinated component, typically a perfluoroalkyl chain, and a nonfluorinated backbone. The nonfluorinated backbone can take a variety of configurations. The important feature of the backbone is that it is capable of forming durable film on the surface of the carpet fiber.

As to the mechanism of soil repellency, it is believed that the attraction between nonpolar soil and the fiber surface is governed by London dispersion forces. Applying fluorochemicals to the surface is thus believed to be effective because the polarizability of perfluoroalkyl chains is lower than that of the hydrocarbons, amines, or carbonyls otherwise found on the surface of a nylon carpet fiber.

Generally, fluorochemicals are topically applied to carpet. One method is to form an aqueous dispersion of the fluorochemical and then spray that dispersion on the top face of the carpet. Another method is to make an aqueous based foam containing the fluorochemical and then apply the foam to the top face of the carpet. Heat is usually applied to drive off excess water and to fix the fluorochemical to the carpet fibers.

Typically, stain resist compounds are applied to carpet from a bath after the dyeing step, but before drying. At least one system is commercially available wherein a fluorochemical and stain resist compound are topically applied in a foam. In particular, the FX-1367F fluorochemical composition and the FX-668F stain resist composition, both from 3M Specialty Chemicals Division, are recommended to be topically co-applied in a foam. The pH of the combined foam is about 4.

SUMMARY OF THE INVENTION

In accordance with one aspect, the invention is a method of treating carpet yarn to enhance its repellency which includes providing a carpet yarn made from polymeric fibers and providing in an aqueous medium with a pH below about 3.5 and a repellency compound comprising an anionic or nonionic fluorochemical. The carpet yarn is contacted with this aqueous medium. The carpet yarn and aqueous medium are preferably heated, after which excess water is removed from the carpet.

In accordance with another aspect of the invention, the aqueous medium further comprises an anionic polymer binding compound, such as a polymer of methacrylic acid.

In accordance with yet another aspect, the invention is a composition for treating carpet to enhance its repellency and stain resistance which includes an aqueous medium, a repellency compound comprising a fluorochemical, and an anionic polymer stain resist compound.

One advantage of the preferred embodiment of the present invention is that it provides a more efficient method of applying fluorochemical and stain resist compound. In particular, since both fluorochemical and stain resist compound are applied in a single bath, the processing, energy and equipment costs are greatly reduced.

Another advantage of the preferred embodiment of the invention is that, as will be shown below, superior repellency results are achieved through the simultaneous application. It is believed that one reason for this improvement is that the present invention provides better penetration of the fluorochemical into the carpet yarn than is achieved through a topical application.

As used herein, the term repellency is intended to have a relatively broad meaning, referring to a reduced tendency for soil, oil and/or water to adhere to the carpet fibers.

As used herein, the term stain resistance is also intended to have a relatively broad meaning, referring to a reduced tendency of the carpet fibers to be stained by acid dyes and/or disperse dyes.

When percentages are given, unless otherwise indicated, they are intended to refer to percentages by weight solids based on the total weight of the aqueous dispersion.

The present invention, together with attendant objects and advantages, will be best understood with reference to the detailed description below.

DETAILED DESCRIPTION OF THE PREFERRED EMBODIMENTS

Various types of carpet yarn can be treated according to the present invention. Preferably, the method is used to treat carpet, namely carpet yarn tufted into a backing material. Alternatively, the carpet yarn can be treated according to the method before it is tufted into carpet.

Typically, the carpet yarn will be made from an extruded synthetic polymer, such as nylon, polyester or polypropylene. Alternatively, the carpet yarn can be made from a natural fiber, such as wool or cotton. Preferably, the carpet yarn is made from extruded fibers of nylon 6, nylon 6,6, polyester and polypropylene. In the aspect of the invention when both a repellency and a stain resist compound are simultaneously applied, the carpet yarn is most preferably made from either nylon 6 or nylon 6,6. In another aspect of the invention, the yarn is preferably made from polypropylene. The present invention has been found to be particularly advantageous in treating polypropylene carpet in that it provides a cost-effective way of increasing the repellency of polypropylene.

The extruded fibers can be made into yarn by various means. Most preferably, the nylon yarn is a bulk continuous filament yarn which is heat set by conventional means, such as the Superba or the Suessen method. Alternatively, the yarn can be a staple spun yarn. Also, it is preferred that the yarn is not pre-treated with a fluorochemical by the yarn manufacturer.

As noted above, it is preferred that the carpet yarn has already been tufted by conventional means into a carpet structure before being treated by the present invention. Neither the stitch pattern nor the density appear to be critical to the practice of the invention. Also, if the carpet is to receive a dye treatment, such as application of an acid dye, it is preferred to complete that dye treatment before treating it by the present invention.

The invention employs an aqueous medium comprising a fluorochemical compound. The fluorochemical compound can be an anionic or nonionic fluorochemical. Also, the fluorochemical can be either the telomer type or the electrochemically fluorinated fluorochemical referred to above. Several commercially available fluorochemical compounds have been shown to work in the method of the present invention. Suitable fluorochemical compounds include the following: FX-1367F and FX-1355 both from 3M Specialty Chemicals Division, NRD-372 from DuPont Flooring Systems, TG-232D from Advanced Polymers, Inc., and Nuva 3555 from Hoechst Celanese. All of these commercially available fluorochemical compositions have been successfully applied through the method of the present invention. Currently, the NRD-372 from DuPont is most preferred.

The level of fluorochemical in the medium will be set so as to produce the desired level on the carpet yarn. Preferably, the fluorochemical is present between about 0.0035 and about 0.175 percent solids of the medium. More preferably, the fluorochemical is present at between about 0.015 and about 0.080 percent, most preferably, about 0.02 percent.

An important feature of the aqueous dispersion is that it has a pH of below about 3.5 when the carpet yarn or carpet is immersed in it. This pH is lower than the pH of conventional fluorochemical compositions applied to carpets. Nevertheless, is believed that the lower pH helps drive the fluorochemical out of solution and onto the carpet yarn fibers. Preferably, the pH of the dispersion is above about 1.0 and below about 3.5, more preferably, between about 1.5 and about 1.8.

This pH can be obtained by adding the appropriate amount of an acid, such as urea sulfate or sulfamic acid, to the aqueous dispersion.

Preferably, the aqueous dispersion also includes an anionic binding compound. More preferably, this anionic binding compound is one that also serves as a stain resist compound, although this function is not required. For example, when the carpet yarn is made from polypropylene, there are no acid dye sites for the anionic binding polymer compound to block. Nevertheless, it has been found that the use of the anionic polymer binding compound has improved the performance of the fluorochemical compound on polypropylene carpet yarn. While not wishing to be bound by any particular theory, it is currently believed that the anionic polymer functions to hold the fluorochemical to the surface of the fiber.

Several anionic polymer binding compounds that also function as stain resist compounds on nylon carpet yarn have been found to work well in the present invention. The preferred anionic polymer binder compounds are polymers or copolymers of methacrylic acid. Preferably, these polymers or copolymers have a molecular weight range such that the lower 90 weight percent has a weight average molecular weight in the range of about 2500 to 250,000 and a number average molecular weight in the range of 500 to 20,000.

Currently, the most preferred anionic polymer binding compound is a polymethacrylic acid commercially available from Rohm & Haas under the designation Leukotan 1028. The molecular weight of the lower 90 weight percent based on weight average for Leukotan 1028 is reported to be 9,460 and based on number average is reported to be 5,592.

Currently, the second most preferred anionic polymer binding compound is a polymer of methacrylic acid designated XP-4-49 which is made according to the procedure described in the examples below. Preferably, the XP-4-49 is mixed with a lesser amount of a phenolic type stain resist compound sold by Sybron Chemicals, Inc. the designation "Tanatex Stainfree." The preferred ratio of XP-4-49 to Tanatex is about 18:1 based on solids. This particular mixture is designated XP-4-50 in the examples below and is the second most preferred anionic polymer binding/stain resist compound to use in the method of the present invention.

Other anionic polymer binding/stain resist compounds have also been shown to work well. The following compositions from 3M Specialty Chemicals Division have worked well: FX-369, FX-668F, FX-661, and FX-657. The principal ingredient of FX-369 is believed to be a phenolic resin. All of the other 3M stain resist compositions are believed to comprise a methacrylic acid polymer or copolymer and to be described in either U.S. Pat. Nos. 4,937,123; 4,822,373 or both.

The composition sold by DuPont Flooring Systems as "SR 300" has also shown good results in the invention. SR 300 is a proprietary composition with a phenolic resin as the principal ingredient.

In addition to the Leukotan 1028 referred to above, other Leukotan compounds from Rohm & Haas have shown promise, namely 1027, 970 and 1084. With the exception of the Leukotan 1084, the Leukotans are all polymers and copolymers of methacrylic acid of varying molecular weights. Although these compounds are generally sold to the tanning industry, U.S. Pat. No. 4,937,123 refers to this group as having stain resist properties when applied to nylon carpet fibers. Leukotan 1084 is believed to be a polymer of acrylic acid.

Preferably, the anionic binding/stain resist compound is present in the aqueous medium at a level between about 0.05 and about 2.5 percent solids, more preferably between about 0.5 and about 1 percent.

Preferably, the aqueous medium is made up by the following procedure. Typically, the fluorochemical and stain resist compounds are provided by the manufacturer in a concentrated aqueous dispersion. These concentrates can be simply added to the remaining water in a vessel and stirred at room temperature. Because some of the fluorochemical and/or stain resist compositions are in emulsion form which can be sensitive to high shear, the stirring is preferably done at low shear. The pH is measured and the appropriate amount of acid is added to bring the pH to the desired level.

In accordance with the invention, the carpet yarn is immersed in the aqueous medium. Preferably, this is accomplished by immersing carpet in a bath of the aqueous medium. Most preferably, the carpet is immersed by drawing it through a puddle of the medium in an apparatus such as that known in the industry as a "flex nip applicator." Alternatively, the carpet can be placed in a vessel containing the aqueous medium. Still further, the aqueous medium can be sprayed or cascaded onto the carpet so as to immerse the carpet.

The amount of aqueous medium applied to the carpet is preferably such that it will provide a ratio of carpet to aqueous medium of at least about 0.5 to 1. A common expression for the amount of liquid applied to carpet is "wet pick-up." By this expression, the preferred wet pick-up is at least about 50 percent. More preferably, the wet pick-up is between about 50 percent and about 6000 percent, i.e. a ratio of 0.5:1 to 60:1. Most preferably, the wet pick-up is between about 200 and about 500%, i.e. a ratio of 2:1 to 5:1. The control of the wet pick-up level can be accomplished by conventional means, such as squeeze rollers and the like.

Heating the aqueous dispersion in contact with the carpet yarn has been found to enhance the performance of the method of the present invention. As shown in the examples below, the heating step greatly shortens the time needed to get good exhaustion of the fluorochemical compound onto the carpet fiber. Thus, although not required, the heating step greatly improves the efficiency of the method. While not wishing to be bound by any particular theory, it is currently believed that the heat treatment helps cure or fix the molecules of fluorochemical to the carpet yarn fibers.

Preferably, this heating step is performed at between about 160° F. and 260° F. for between 15 second and about 60 minutes, more preferably between about 180° F. and about 220° F. for between about 30 seconds and about 8 minutes. Most preferably, the heating step is accomplished by exposing the carpet with the aqueous medium to steam at ambient pressure, i.e. 212° F. for about 1.5 minutes.

After the heating step, the carpet is preferably rinsed to remove excess chemicals. This rinsing can be done by conventional means.

After rinsing, the excess water is preferably removed by conventional means, such as a Bock centrifuge. Typically, the water content after centrifuging will be about 20–30 percent.

After the excess water is removed, the carpet is preferably dried in a conventional oven. Typically, the carpet is dried at about 220° F. for between about 6 and about 8 minutes.

EXAMPLES

The following examples are provided by way of explanation and illustration. As such, these examples are not to be viewed as limiting the scope of the invention as defined by the appended claims.

Ingredients and Materials

Carpet Construction

The pieces of carpet used in the following examples were made with the various face yarns as noted below:

Where the example refers to a nylon 6 staple yarn, this is a type 316 yarn from Allied Signal.

Where the example refers to a nylon 6 filament yarn, this is a type 1190 yarn from Allied Signal.

Where the example refers to a nylon 6,6 filament yarn, this is a Suessen set type 1150 yarn from DuPont.

Where the example refers to a nylon 6,6 staple yarn, this is a type 1993 staple yarn from Monsanto.

Where the example refers to a polypropylene yarn, this is a Type 1450 filament yarn from Shaw Industries, Inc.

Where the example refers to a PET filament yarn, this is a type 1450 yarn from Shaw Industries, Inc.

Where the example refers to a PET carrierless staple yarn, this is a type 837 yarn from Hoechst Celanese Corp.

Where the example refers to a PET carrier staple yarn, this is a type 804 yarn from Hoechst Celanese Corp.

Where the example refers to a Superba set yarn, this is a yarn that has been heat set with saturated steam under pressure in a continuous heat setting unit.

Where the example refers to a Suessen set yarn, this is a yarn that has been heat set with super heated steam under pressure in a continuous heat setting unit.

Each of these yarns was tufted into a polypropylene backing material by conventional methods and apparatus.

With the exception of examples 20a–20q which used full-width carpet on a production scale experiment, the carpet for the remaining examples was cut into 6"×12" sample pieces. Each of these sample pieces were weighed so that accurate chemical add-on and/or liquor wet pick-UPS could be calculated.

Fluorochemicals

FX-1367F

One of the fluorochemical compositions used in the examples below is that sold by 3M Specialty Chemicals Division under the designation "FX-1367F." This is a proprietary product with the principal ingredient being an electrochemically fluorinated type, anionic fluorochemical. FX-1367F is reported to be especially suited for application by foam to nylon, polyester, wool and acrylic carpets. The product obtained from 3M is an aqueous dispersion containing about 40–42% solids.

NRD-372

Another of the fluorochemical compositions used in the examples below is that sold by DuPont Flooring Systems under the designation "NRD-372." This is another proprietary product with the principal ingredient being a telomer fluorochemical. The product obtained from DuPont is an aqueous dispersion containing about 15–35% solids.

T232D

Yet another fluorochemical composition used in the examples below is sold by Advanced Polymers, Inc. under the designation "Texguard 232D" or "TG-232D" for short. This is likewise a proprietary product described as a fluoroalkyl acrylate copolymer emulsion. Although a solids percent is not reported for this product, when dried in an oven at 220° F., the remaining solids are about 27 percent of the original weight.

Anionic Stain Resist/Binding Compounds

The following anionic stain resist/binding compounds were used in the examples below.

XP-4-49 and XP-4-50

As noted above, the second most preferred stain resist compound to use in the present invention is a polymethacrylic acid polymer referred to as XP-4-49 with small amount of "Stainfree" from Sybron. This combination is referred to as XP-4-50.

A batch of XP-4-49 was made in a reaction vessel, equipped with a reflux condenser, heating, agitation, thermometer, and an inert gas blanket. To this vessel was added 54 lbs of methacrylic acid, 452 lbs of water, and 1.0 lbs of NaOH. This was referred to as aqueous phase A.

Monomer feed B was prepared by mixing 214 lbs of methacrylic acid, 303 lbs of water, 0.16 lbs of diallyl maleate and 2.2 lbs of NaOH.

Two catalyst feeds were also prepared. Feed C consisted of 2.2 lbs potassium persulfate and 197 lbs of water. Feed D consisted of 2.2 lbs of sodium metabisulfite and 197 lbs of water.

Mixture A was heated to a temperature of 85°–90° C. under a nitrogen blanket for 30 minutes. 1.3 lbs of potassium persulfate and 1.3 lbs of sodium metabisulfite were added to initiate the reaction, resulting in a small exotherm of 3° to 5° C. Feeds B, C and D were then added to the reaction vessel over a one hour period with the temperature of the vessel maintained at 90° to 95° C. At the end of the addition period, the batch was held at a temperature of 90° to 95° C. for one hour. During this hour, 0.35 lbs of potassium persulfate, 0.35 lbs of sodium metabisulfite and 2.2 lbs NaOH were added every 15 minutes for a total of 3 additions.

The resulting product, referred to as XP-4-49, was a slightly hazy, viscous liquid with 20.4% solids, a pH of 3.7 and a viscosity of 4800 cps measured on a Brookfield Viscometer with a #2 spindle at room temperature.

To make XP-4-50, 73.1 parts of XP-4-49, including the water in which it was made, are added to 24.5 parts water and 2.4 parts Sybron Stainfree. The solids content of the Sybron Stainfree is about 35%. Consequently, the preferred ratio of solids from the XP-4-49 polymer to the solids from the Stainfree is about 18 to 1. This mixture was a clear, viscous, amber liquid with a final viscosity of 68 cps.

3M Stain Resist Compounds

Several stain resist compounds from Minnesota Mining & Mfg. Co. were tested in the examples below. FX-389 is a proprietary stain resist compound from 3M with a principal ingredient being a phenolic resin. FX-888F and FX-661 are other proprietary stain resist compounds from 3M with a polymer of methacrylic acid as the principal ingredient. Finally, FX-657 is a proprietary stain resist compound from 3M having a phenolic-methacrylic acid copolymer as the principal ingredient.

Acrylic Acid and Methacrylic Acid Polymers from Rohm & Haas

The following acrylic and methacrylic acid based polymers were all obtained from Rohm & Haas: Leukotan 1027, Leukotan 1028, Leukotan 970, and Leukotan 1084.

Other Stain Resist

A stain resist composition from DuPont was tested, namely SR-300. This is a proprietary product with a Styrene-maleic anhydride copolymer with a phenolic resin. Finally, a stain resist composition from Sybron Chemicals, Inc. was obtained under the designation "Tanastain 100." This composition has a modified phenolic resin as the principal ingredient.

Other Ingredients

The acid used to adjust the pH was commercially available urea sulfate.

Methods

Except for the variances noted below, the examples were all performed according to the following methods.

Dyeing Simulation

The pieces of carpet were first treated to simulate the dyeing process that carpet would typically encounter in the total manufacturing process.

Each sample piece was identified with a laundry tag indicating the specific lab trial number. The sample pieces were placed in a horizontal lab steamer and steamed for 30 seconds, face-up, to simulate the pre-steaming step on a continuous dye line.

The pre-steamed pieces were allowed to cool for 30 seconds, and then placed in a flat pan applicator, which contained the desired dyebath mixture and liquor amount. The blank dyebaths used in these examples contained a 0.105% solution weight Dowfax 2000 surfactant, and a phosphoric acid buffer to set the pH at the desired range, i.e. about 5.5. Production dyebaths contain the above two chemicals, along with desired level of dyes.

The wet-out sample pieces were then placed in a horizontal steamer for 4.0 minutes. The pieces were steamed for 2.0 minutes with the tufts facing up, and the final 2.0 minutes with the tufts facing down, to give good liquor flow.

The steamed pieces were then removed from the steamer and immersed in a 3 gallon volume of ambient tap water, for 10 to 15 seconds, to simulate a washing step. The pieces were then extracted in a high speed BOCK centrifuge for 4.0 minutes to pull the moisture level down to the 20–30% wet pick-up range.

Application of Stain Resist Compound and/or Fluorochemical

Application of Fluorochemical from a Bath

In some of the examples below, a fluorochemical was applied by immersing the extracted sample pieces in an aqueous dispersion containing one of the fluorochemical compositions described above. The liquor in the flat pan applicator for these examples was made up with anionic fluorochemical in the range of 0.010% to 0.090% solids, and an acid for pH adjustment to the desired range. The extracted fabric was wet out in this liquor, in the 350–400% wet-pick-up range, and subsequently steamed.

Simultaneous Application of Fluorochemical and Stain Resist Compound

In some other of the examples below, a fluorochemical and an anionic polymer stain resist compound were applied simultaneously. This was accomplished by immersing the extracted sample pieces in an aqueous dispersion containing both a fluorochemical and an anionic polymer stain resist compound. The liquor in the flat pan applicator for these examples was made up with anionic polymers in the solids range of 0.100 to 0.290% solids, anionic fluorochemical in the range of 0.010% to 0.090% solids, and an acid for pH adjustment into the range of 1.5–1.80. The extracted fabric was wet out in this liquor, in the 350–400% wet-pick-up range, and subsequently steamed.

Conventional Stain resist compound Application

In still other of the examples below, a conventional application of an anionic polymer stain resist compound was used. This was accomplished by immersing the sample piece in a solution of the stain resist compound to be used. Specifically, after the centrifuge extraction step described above, the sample pieces were again placed in a flat pan applicator that contains a conventional stain resist compound liquor. The application wet-pick-up was 400%. The typical conventional stain resist compound bath contained a stain resist compound at 0.120 to 0.290% solids, and an acid (typically Urea Sulfate) to adjust the pH to the desired range. The typical pH range for conventional stain resist compound application was 2.0–2.5.

Conventional Fluorochemical Application

In still other examples performed for purposes of comparison, a fluorochemical was applied in a way to simulate a conventional application, as a topical treatment by a spray bar in a step subsequent to the application of a stain resist compound. In these example, the extracted sample pieces, were placed in a flat pan, pile down, for application of a solution containing fluorocarbon in the range of 0.15 to 1.75% solids, with the pH in the range of 3.5–7.5 units. The lab application is made in the 100% wet-pick-up range to ensure adequate pile penetration for the solution. The pieces with this conventional application of fluorochemical were dried without the steam fixation or rinse extraction step described below.

Steaming

The wet-out sample pieces were placed in the horizontal steamer for 1.5 minutes of steaming to fix the fluorochemical, the stain resist compound or the combination of both on the carpet fibers. The fabric was steamed for 45 seconds with the tufted pile up, and 45 seconds with the tufted pile down to achieve liquor flow.

Rinse/Extraction

The steamed sample pieces were then removed from the steamer and immersed in a 3 gallon volume of ambient tap water, for 10 to 15 seconds, to simulate a washing step. The sample pieces were then extracted in a high speed BOCK centrifuge for 4.0 minutes to pull the moisture level down to the 20–30% WPU range.

Drying

The extracted sample pieces, or the pieces with a topical application of fluorochemical, were then placed, with the pile up, in an electrically heated, forced air oven operating at 220° F. for 6–8 minutes. The sample pieces had a moisture content in the range of 1–2% when removed from the oven.

Test Methods

The products of the examples were tested by one or more of the following test methods:

PPM Fluorine

The test to measure the level of fluorochemical applied to the carpet samples below was the "NYLON FLUORINE CONTENT—COMBUSTION FLASK OXIDATION/SPECIFIC ION METER" test published in October 1983 by the Textile Fibers Department of E. I. DuPont De Nemours & Company, Inc. under the number TM-371-66, N-M 27414.00. Briefly stated, the test is conducted by burning the sample in an oxygen combustion flask. The fluoride is absorbed in a sodium hydroxide solution and the pH and ionic strength of that solution is adjusted. The concentration (activity) of the fluoride ion is measured potentiometrically. The results are reported as parts per million fluorine.

Repellency Tests

The following tests were run to determine the repellency of the carpet samples:

Oil Repellency

The test method published in December 1992 by 3M Specialty Chemicals Division as "3M Carpet Oil Repellency Test III" was used below. In this test, five 5 mm drops of oil are placed from a height of 3 mm onto the carpet surface to be tested. The oil used is supplied by 3M under the designation "Oily Test Liquid C." If after 10 seconds, four out of the five drops are still visible as spherical to hemispherical, the carpet is given a passing rating. Some samples are given a "marginal" rating, designated by a "(M)" after the P or F, and meaning that the sample narrowly passed, or narrowly failed.

Water Repellency

The test method published in December 1992 by 3M Specialty Chemicals Division as "3M Carpet Water Repellency Test V" was also used below. This test is the same as the oil repellency test above, with the exception that drops of deionized water are used in place of oil.

Water/Alcohol Repellency

The samples were also tested to determine the repellency to a water and alcohol mixture. Specifically, the same procedure as the water repellency test above was used except that, instead of water, a mixture of 90% deionized water and 10% isopropyl alcohol was used.

Soil Repellency

The samples from examples 20a–q were also tested for repellency to soiling. This was accomplished through the use of a device sold by James H. Heal & Co. of Yorkshire England under the designation "Kappasoil Rapid Soil Applicator." The object of this device is to replicate traffic and soiling conditions on carpet. This is done by placing carpet samples to fit on the turntable on the device. The turntable rotates the sample through a set number of revolutions and reverses the direction at a set interval so that the pile is uniformly "trafficked" from each direction.

As the turntable rotates, a synthetic soil is metered into the device and applied to the carpet. Face rollers on the turntable mechanically force the soil into intimate contact with the carpet pile. After the predetermined number of revolutions, the carpet samples are removed from the device and lightly vacuumed to pull off loosely adhered soil.

The samples are then graded for color change versus an unsoiled control. While this can be done manually, with the AATCC grey scale, it was done for examples 20a–q by the use of a MacBeth Eagle-Eye spectrophotometer. The reflectance data was converted to L*a*b* units using the 1976 CIE L*a*b* color equations. The data reported below is the $\Delta L^*$ values which indicate the degree of darkening, due to soiling, of the samples soiled in the Kappasoil tester as compared to the unsoiled control. Low absolute values of $\Delta L^*$ indicate a low degree of darkening due to soil adhering to the carpet fibers, thus a low degree of soiling potential relative to samples with higher $\Delta L^*$ values.

Stain Resistance

Resistance to Staining by Acid Red #40

The test method published in December 1992 by 3M Specialty Chemicals Division as "3M Carpet Stain Release Test II" was used below. In this test, the stain resistance of a carpet sample is tested by applying a small volume of an aqueous solution of Food, Drug & Cosmetic Red 40. The staining solution is made with 80 mg. of dye per liter of deionized water and has a pH of 3.0±0.2. A staining ring with a 2 inch opening is used to apply 20 ml of the staining solution on the carpet sample. Once the 20 ml is absorbed into the carpet, the staining ring is removed and the sample is left undisturbed for 24±2 hrs. The sample is rinsed with tap water until the rinse water is clear. Excess water is removed and the sample is oven dried at about 100° C for 90 minutes. The sample is then rated against the grey scale for color change provided by the American Associate of Textile Colorist and Chemists (AATCC). This scale goes from 1 to 5 with 1 indicating severe color change and 5 indicating no color change. A score of 4 is generally considered acceptable on this test.

Resistance to Staining by Mustard

The resistance to staining by mustard is conducted in a manner similar to that for Acid Red #40, with the exception that the staining solution is made by adding 75 grams of French's mustard (containing tumeric) to 1 liter of tap water. The carpet samples are allowed to sit in the mustard mixture for 30 seconds then drained. After sitting for 24 hrs., the samples are rinsed and dried. After drying the samples are rated on the same AATCC grey scale for color change.

Resistance to Staining by Coffee at 140° F.

The test for resistance to staining by coffee is similar to that for mustard. The staining solution is made from regular strength instant coffee brewed and brought to a temperature of about 140° F. The carpet samples were immersed in the coffee for 30 seconds. The samples were allowed to sit for 30 minutes, then rinsed and dried. After drying, the samples were rated on the same AATCC grey scale for color change. A score of 4 is generally considered acceptable on this test.

"WAQE" Stain Resistance Durability Test

The samples in examples 20a–k were tested to determine the durability of the stain resistant properties. This is accomplished by mixing up a detergent solution containing 2.2 oz. of DuPont's "DuPonol/WAQE" detergent per gallon of water. The pH of this solution is adjusted to 10.0 with a 10 percent TriSodium Phosphate solution. Samples of the carpet to be tested are then immersed in the detergent solution for 5 minutes. The sample is then rinsed thoroughly under a faucet, hand squeezed and extracted with a centrifugal extractor to remove excess water. After the carpet has been thus treated and dried, the same stain resistance test with Acid Red No. 40 is performed and the color difference is rated by the same AATCC grey scale.

Other Tests for Colorfastness

Exposure to Ozone

Some of the samples in examples 20a–q were also tested for colorfastness when exposed to ozone. In particular, the AATCC test method 129-1990 was performed and the exposed samples were graded on the AATCC grey scale.

Exposure to $NO_x$

Some of the samples in examples 20a–q were also tested for colorfastness when exposed to $NO_2$. In particular, the AATCC test method 164-1987 was performed and the exposed samples were graded on the AATCC grey scale.

Exposure to Xenon Lamp

The samples in examples 20a–q were also tested for colorfastness when exposed to light from a xenon lamp for 40 hours. In particular, the AATCC test method 16-1990 was performed and the exposed samples were graded on the AATCC grey scale.

Fluorochemical Penetration

The carpet from examples 20a–q were also tested to determine the penetration of the fluorochemical treatment. This was accomplished by first measuring the average pile height of a 1 by 3 inch sample of carpet. Then, a quantity of Wesson oil with 0.2 g of oil red 0 per gallon of oil was placed in a clear baking dish. The carpet sample was placed in the dish so that the oil came just over the top of the primary backing. The samples were left in the dish for 45 minutes. The average height of oil absorbed on the yarn from the carpet backing for each pile height was then measured. The results are reported as the percentage of the average pile height which did not have oil absorbed on it over the entire average pile height. Thus, the higher the percentage, the further down the fluorochemical penetrated into the pile.

EXAMPLES 1a–1p

Application of Fluorochemicals Alone and With Stain resist compounds on Nylon Examples 1a–1p were performed to demonstrate the invention on nylon 6 and nylon 6,6 of carpet face fiber. The yarn in examples 1a–1h was the nylon 6 yarn described above. In examples 1a–1d, the yarn was Suessen set and tufted at 32 osy. In examples 1e–1h, the yarn was Superba set and was tufted at 25.5 osy. The yarn in examples 1i–1 p was the nylon 6,6 yarn described above. In examples 1i–1l, the yarn was Suessen set and was tufted at 30.3 osy. In examples 1m–1p, the yarn was Superba set and was tufted at 35 osy.

All of the 16 carpet sample pieces were prepared as described above, i.e. including the dye bath simulation. As noted in Table 1 below, the extracted pieces were then treated with either the FX1367F or the T232D fluorochemical alone or one of those fluorochemicals together with the XP-4-50 stain resist compound by the methods described above. In all of examples 1a–1p, the pH of the bath was 1.8 and the wet pick-up was 400%. The pieces were steamed, washed, extracted and dried all as described above.

After drying, the sample carpet pieces were each tested for oil, water, and water/alcohol repellency and for fluorine content by the test methods described above. The results are reported in Table 1.

As can be seen the FX1367 (compare examples 1a to 1b, 1i to 1j, and 1m to 1n) was more impacted by the addition of the XP-4-50 to the application bath than was the T232D (compare examples 1c to 1d, 1k to 1l, and 1o to 1p).

TABLE 1

| No. | Fiber Type | FX 1367 | T232D | XP-4-50 | Oil | $H_2O$ | $H_2O$/Alc | ppm F |
|---|---|---|---|---|---|---|---|---|
| 1a | N6 Suessen | X | | | P | P | P | 367 |
| 1b | | X | | X | P | P | F | 128 |
| 1c | | | X | | P | P | P | 416 |
| 1d | | | X | X | P | P | P | 320 |
| 1e | N6 Superba | X | | | P | P | P | 553 |
| 1f | | X | | X | P | P | P | 321 |
| 1g | | | X | | P | P | P | 389 |
| 1h | | | X | X | P | P | P | 309 |
| 1i | N6,6 Suessen | X | | | P | P | P | 267 |
| 1j | | X | | X | P | P | F | 104 |
| 1k | | | X | | P | P | P | 384 |
| 1l | | | X | X | P | P | P | 272 |
| 1m | N6,6 Superba | X | | | P | P | P | 473 |
| 1n | | X | | X | P | P | F | 126 |
| 1o | | | X | | P | P | P | 397 |
| 1p | | | X | X | P | P | P | 289 |

EXAMPLES 2a–2p

Application of Fluorochemical Alone and With Stain Resist compound on PET and PP Examples 2a–2p were performed exactly as examples 1a–1p except that different types of face fibers were used. In examples 2a–2d, the yarn was as the Superba set PET filament described above and was tufted at 33 osy. In examples 2e–h, the yarn was the carrierless polyester staple described above and was tufted at 34 osy. In examples 2i–2l, the yarn was the carrier polyester staple from Hoechst Celanese described above and was tufted at 40 osy. In examples 2m–2p, the yarn was the Superba set polypropylene filament produced by Shaw Industries, Inc. described above tufted at 26 osy. The results are reported in Table 2.

These results show that the T232D worked better on the PET samples than did the FX 1367. Also, as can be seen by comparing examples 2m to 2n and 2o to 2p, the addition of the anionic binding polymer XP-4-50 greatly enhanced the performance of both fluorochemicals on the polypropylene samples.

TABLE 2

| No. | Fiber Type | FX 1367 | T232D | XP-4-50 | Oil | $H_2O$ | $H_2O$/Alc | ppm F |
|---|---|---|---|---|---|---|---|---|
| 2a | PET Superba | X | | | P | P | P | 124 |
| 2b | | X | | X | P | P | F | 111 |
| 2c | | | X | | P | P | P | 304 |
| 2d | | | X | X | P | P | P | 224 |
| 2e | PET 837 | X | | | P | P | P | 166 |
| 2f | | X | | X | P | P | P | 861 |
| 2g | | | X | | P | P | P | 346 |

TABLE 2-continued

| No. | Fiber Type | FX 1367 | T232D | XP-4-50 | Oil | $H_2O$ | $H_2O$/Alc | ppm F |
|---|---|---|---|---|---|---|---|---|
| 2h | | | X | X | P | P | P | 253 |
| 2i | PET 804 | X | | | P | P | P | 126 |
| 2j | | X | | X | P | P | F | 76 |
| 2k | | | X | | P | P | P | 212 |
| 2l | | | X | X | P | P | P | 216 |
| 2m | PP Superba | X | | | F | P | P | 135 |
| 2n | | X | | X | P | P | F | 229 |
| 2o | | | X | | F | P | P | 90 |
| 2p | | | X | X | P | P | P | 313 |

EXAMPLES 3a–3i

Application of Fluorochemical with XP-4-50 and SR-300 on Polypropylene

Examples 3a–3h were performed exactly as examples 2m–2p except that the Superba set polypropylene yarn was tufted at 22 osy, two different pH levels for the bath were used and the XP-4-50 and SR-300 stain resist compounds were compared. Example 3i was tested as a control. Example 3i was made with the 22 osy Superba set polypropylene yarn, was treated in the dye bath simulation, but was not treated to add either fluorochemical or stain resist compound. The results are reported in Table 3.

These results indicate that the XP-4-50 did generally better than the SR-300 when applied to polypropylene.

TABLE 3

| No. | pH | FX 1367 | T232D | XP-4-50 | SR-300 | Oil | $H_2O$ | $H_2O$/Alc | ppm F |
|---|---|---|---|---|---|---|---|---|---|
| 3a | 1.8 | X | | X | | P | P | P | 184 |
| 3b | 1.5 | X | | X | | P | P | F | 283 |
| 3c | 1.8 | | X | X | | P | P | P | 391 |
| 3d | 1.5 | | X | X | | P | P | P | 317 |
| 3e | 1.8 | X | | | X | F(M) | P | P | 143 |
| 3f | 1.5 | X | | | X | P | P | P | 188 |
| 3g | 1.8 | | X | | X | P | P | P | 163 |
| 3h | 1.5 | | X | | X | P | P | P | 237 |
| 3i | 1.8 | | | | | F | P | F | N/A |

EXAMPLES 4a–4p pH Effect on Fluorochemical Only Applied to Nylon 6,6

Examples 4a–4p were performed to observe the effect of the pH of the aqueous dispersion of fluorochemical. The carpet sample pieces used in these examples were made with the nylon 6,6 yarn described above which was Superba set also as described above. The yarn was tufted to give a density of 35 osy. The carpet sample pieces were all treated in the dye bath simulation method described above. A fluorochemical was then applied by the immersion method described above. The liquor for the fluorochemical application included 0.6% of the NRD372 composition described above and urea sulfate to adjust the pH to the level noted below. The balance of the liquor was water. The pieces were steamed, rinsed, extracted and dried as described above. The carpet sample pieces were then tested in the oil repellency, water repellency, and water/alcohol repellency tests described above. The pieces were also tested to determine the level of fluorine as described above. The results are reported in Table 4.

These results show the dramatic decline in fluorochemical performance when the pH of the application bath is not below about 3.5.

TABLE 4

| Ex. No. | pH | Oil | Water | Water/Alcohol | ppm F |
|---|---|---|---|---|---|
| 4a | 1.5 | P | P | P | 757 |
| 4b | 1.6 | P | P | P | 787 |
| 4c | 1.7 | P | P | P | 769 |
| 4d | 1.8 | P | P | P | 749 |
| 4e | 1.9 | P | P | P | 698 |
| 4f | 2.0 | P | P | P | 731 |
| 4g | 2.1 | P | P | P | 733 |
| 4h | 2.2 | P | P | P | 737 |
| 4i | 2.5 | P | P | P | 388 |
| 4j | 3.0 | P | P | P | 372 |
| 4k | 3.5 | P | P | P | 80 |
| 4l | 4.0 | P(M) | F | F | 32 |
| 4m | 4.5 | F | F(M) | F(M) | 42 |
| 4n | 5.0 | F | F | F | 30 |
| 4o | 5.5 | F | F | F | 34 |
| 4p | 6.0 | F | F | F | 61 |

EXAMPLES 5a–5p pH Effect on Fluorochemical Only Applied to Nylon 6

Examples 5a–5p were performed and tested exactly the same as Examples 4a–4p with the exception that the nylon 6 yarn described above was used in place of the nylon 6,6 yarn. The nylon 6 yarn was Superba set and was tufted at 25.5 osy. The results are in Table 5.

These results show the decline in fluorochemical performance on nylon 6 when the pH is 3 or above.

TABLE 5

| Ex. No. | pH | Oil | Water | Water/Alcohol | ppm F |
|---|---|---|---|---|---|
| 5a | 1.5 | P | P | P | 750 |
| 5b | 1.6 | P | P | P | 768 |
| 5c | 1.7 | P | P | P | 759 |
| 5d | 1.8 | P | P | P | 683 |
| 5e | 1.9 | P | P | P | 698 |
| 5f | 2.0 | P | P | P | 649 |
| 5g | 2.1 | P | P | P | 675 |
| 5h | 2.2 | P | P | P | 633 |
| 5i | 2.5 | P | P | P | 389 |
| 5j | 3.0 | F | F | F | 61 |
| 5k | 3.5 | F | F | F | 43 |
| 5l | 4.0 | F | F | F | 29 |
| 5m | 4.5 | F | F | F | 34 |

TABLE 5-continued

| Ex. No. | pH | Oil | Water | Water/ Alcohol | ppm F |
|---|---|---|---|---|---|
| 5n | 5.0 | F | F | F | 36 |
| 5o | 5.5 | F | F | F | 41 |
| 5p | 6.0 | F | F | F | 38 |

EXAMPLES 6a–6h pH Effect on Fluorochemical and Anionic Polymer Applied to Nylon 6,6

Examples 6a–6h were performed and tested exactly the same as Examples 4a–4h with the exception that the XP-4-50 anionic polymer stain resist compound described above was added to the liquor with the NRD372 fluorochemical. The XP-4-50 solution was added at 3.3% giving a weight solids level of 0.120% The results of the tests are in shown Table 6.

These results demonstrate preferred maximum pH of 1.8 when the fluorochemical and stain resist compound are applied simultaneously to nylon 6,6.

TABLE 6

| Ex. No. | pH | Oil | Water | Water/ Alcohol | ppm F |
|---|---|---|---|---|---|
| 6a | 1.5 | P | P | P | 582 |
| 6b | 1.6 | P | P | P | 582 |
| 6c | 1.7 | P | P | P | 545 |
| 6d | 1.8 | P | P | P | 316 |
| 6e | 1.9 | F | F | F | 87 |
| 6f | 2.0 | F | F | F | 62 |
| 6g | 2.1 | F | F | F | 42 |
| 6h | 2.2 | F | F | F | 41 |

EXAMPLES 7a–7h pH Effect on Fluorochemical and Anionic Polymer Applied to Nylon 6

Examples 7a–7h were performed and tested exactly the same as Examples 5a–5h with the exception that the XP-4-50 anionic polymer stain resist compound described above was added to the liquor with the NRD372 fluorochemical. The XP-4-50 solution was added at 3.3% giving a weight solids level of 0.120% The results of the tests are in shown Table 7.

Though not as dramatic, these results show the preferred maximum pH of 2.0 when working with nylon 6.

TABLE 7

| Ex. No. | pH | Oil | Water | Water/ Alcohol | ppm F |
|---|---|---|---|---|---|
| 7a | 1.5 | P | P | P | 522 |
| 7b | 1.6 | P | P | P | 457 |
| 7c | 1.7 | P | P | P | 489 |
| 7d | 1.8 | P | P | P | 602 |
| 7e | 1.9 | P | P | P | 452 |
| 7f | 2.0 | P | P | P | 319 |
| 7g | 2.1 | F | P | P | 195 |
| 7h | 2.2 | F | P | P | 208 |

EXAMPLES 8a–8i

Effect of Time on Fluorochemical and Anionic Polymer Applied to Nylon 6,6 Without a Heating Step at pH of 1.5

Examples 8a–8i were performed to study the effect of time on samples having a fluorochemical and stain resist compound applied without a heating step. With the exception of the time the carpet samples were left in contact with the aqueous medium and the absence of a heating step, examples 8a–8h were performed the same as example 6a, i.e. with a pH of the aqueous medium being set at 1.5. Example 8i was performed as a control and included a 3 minute steam treatment. The results of the tests on these samples, including the Acid Red 40 stain test, are in shown Table 8.

These results show that the performance of the fluorochemical application without a heating step improves with dwell time.

TABLE 8

| Ex. No. | time (hrs.) | AR 40 | Oil | Water | Water/ Alcohol | ppm F |
|---|---|---|---|---|---|---|
| 8a | 1 | 2 | F | P | P | 116 |
| 8b | 2 | 2–3 | P | P | P | 155 |
| 8c | 3 | 3 | P | P | P | 165 |
| 8d | 4 | 3–4 | P | P | P | 206 |
| 8e | 8 | 3–4 | P | P | P | 264 |
| 8f | 24 | 4 | P | P | P | 273 |
| 8g | 48 | 4 | P | P | P | 258 |
| 8h | 72 | 4–5 | P | P | P | 257 |
| 8i | 3 min. | 5 | P | P | P | 297 |

EXAMPLES 9a–9f

Effect of Time on Fluorochemical and Anionic Polymer Applied to Nylon 6,6 Without a Heating Step at pH of 1.8

Examples 9a–9f were performed the same as examples 8d–8i, with the one exception that the aqueous medium was prepared with a pH of 1.8 Example 9f was performed as a control and included a 3 minute steam treatment. The results of the tests on these samples, including the Acid Red 40 stain test, are in shown Table 9.

Comparing these results with those from Table 8 shows that the pH of 1.5 in examples 8a–h gave better results than the pH of 1.8 in examples 9a–e.

TABLE 9

| Ex. No. | time (hrs.) | AR 40 | Oil | Water | Water/ Alcohol | ppm F |
|---|---|---|---|---|---|---|
| 9a | 4 | 2 | F | P | F(M) | 73 |
| 9b | 8 | 3–4 | F | P | F(M) | 89 |
| 9c | 24 | 3 | F | P | F | 80 |
| 9d | 48 | 4 | F | P | P(M) | 93 |
| 9e | 72 | 4 | F | P | P | 88 |
| 9f | 3 min | 4 | P | P | P | 346 |

EXAMPLES 10a–10i

Effect of Time on Fluorochemical and Anionic Polymer Applied to Nylon 6 Without a Heating Step at pH of 1.5

Examples 10a–10i were performed exactly the same as examples 8a–8i with the exception that the Superba set nylon 6 yarn described above tufted at 25.5 osy was used instead of the nylon 6,6. The results of the tests on these samples are in shown Table 10.

These results are similar to those with nylon 6,6 in examples 8a–i.

TABLE 10

| Ex. No. | time (hrs.) | AR 40 | Oil | Water | Water/ Alcohol | ppm F |
|---|---|---|---|---|---|---|
| 10a | 1 | 1–2 | F | P | P | 95 |
| 10b | 2 | 2 | F | P | P | 123 |
| 10c | 3 | 2 | P | P | P | 157 |
| 10d | 4 | 2–3 | P | P | P | 233 |
| 10e | 8 | 2–3 | P | P | P | 251 |
| 10f | 24 | 2–3 | P | P | P | 249 |
| 10g | 48 | 2–3 | P | P | P | 283 |
| 10h | 72 | 3 | P | P | P | 285 |
| 10i | 3 min. | 2 | P | P | P | 270 |

EXAMPLES 11a–11f

Effect of Time on Fluorochemical and Anionic Polymer Applied to Nylon 6 Without a Heating Step at pH of 1.8

Examples 11a–11f were performed the same as examples 9a–9f, with the one exception that the Superba set nylon 6 yarn described above tufted at 25.5 osy was used instead of the nylon 6,6. The results of the tests on these samples are in shown Table 11.

These results are similar to those for nylon 6,6 in Table 9.

TABLE 11

| Ex. No. | time (hrs.) | AR 40 | Oil | Water | Water/ Alcohol | ppm F |
|---|---|---|---|---|---|---|
| 11a | 4 | 2–3 | F | P | F(M) | 73 |
| 11b | 8 | 2 | F | P | F(M) | 68 |
| 11c | 24 | 2–3 | F | P | F | 74 |
| 11d | 48 | 2–3 | F | P | F | 71 |

TABLE 11-continued

| Ex. No. | time (hrs.) | AR 40 | Oil | Water | Water/ Alcohol | ppm F |
|---|---|---|---|---|---|---|
| 11e | 72 | 3 | F | P | P | 91 |
| 11f | 3 min | 2 | P | P | P | 301 |

EXAMPLES 12a–12x

Various Anionic Polymers Applied to Nylon 6 at 1.0% solids and a pH of 1.5

Examples 12a–12k were performed to compare the use of various anionic binder polymers used with two different fluorochemical compounds. In particular, 12 different anionic polymers, all described above, were applied in a bath which contained either the T232D fluorochemical or the FX1367F fluorochemical. The carpet was made from nylon 6 tufted at 25.5 osy. In each example, the anionic polymer was present at about 0.25% of the bath. When used, the T232D fluorochemical was present at about 0.0135 % of the bath. When used, the FX1367F fluorochemical was present at 0.05% of the bath. The pH of the bath was adjusted to 1.5. The other levels, as well as the methods, times and temperatures were the same as in examples 1. The results of the tests on these samples are in shown Table 12.

TABLE 12

| Ex. No. | Anionic Polymer | FC Used | AR 40 | Oil | Water | Water/ Alcohol | ppm F |
|---|---|---|---|---|---|---|---|
| 12a | FX369 | T232D | 5 | F | F(M) | F | 63 |
| 12b | FX369 | FX1367F | 5 | F | F(M) | F | 102 |
| 12c | FX668 | T232D | 5 | F | P | P | 87 |
| 12d | FX668 | FX1367F | 5 | P | F(M) | F | 76 |
| 12e | FX661 | T232D | 5 | F(M) | P | P | 61 |
| 12f | FX661 | FX1367F | 5 | F(M) | P(M) | F | 78 |
| 12g | FX657 | T232D | 5 | P | P | P | 170 |
| 12h | FX657 | FX1367F | 4–5 | P | P | P | 208 |
| 12i | SR300 | T232D | 2–3 | P | P | P | 136 |
| 12j | SR300 | FX1367F | 2–3 | P | P | P | 200 |
| 12k | LK1027 | T232D | 5 | F | P | P | 82 |
| 12l | LK1027 | FX1367F | 5 | P(M) | P | P | 170 |
| 12m | LK1028 | T232D | 4–5 | F | P | F(M) | 148 |
| 12n | LK1028 | FX1367F | 4–5 | F | F(M) | F | 159 |
| 12o | LK970 | T232D | 4–5 | F | P | F | 148 |
| 12p | LK970 | FX1367F | 4–5 | F(M) | F(M) | F | 180 |
| 12q | LK1084 | T232D | 1–2 | F | F | F | 55 |
| 12r | LK1084 | FX1367F | 1–2 | P | F | F | 135 |
| 12s | TS100 | T232D | 4 | F | F | F | 51 |
| 12t | TS100 | FX1367F | 4–5 | F | F | F | 49 |
| 12u | XP-4-49 | T232D | 4–5 | F(M) | P | P | 120 |
| 12v | XP-4-49 | FX1367F | 4–5 | P(M) | P | F | 203 |
| 12w | XP-4-50 | T232D | 5 | F | P | P | 167 |
| 12x | XP-4-50 | FX1367F | 5 | P | P | P(M) | 185 |

EXAMPLES 13a–13x

Various Anionic Polymers Applied to Nylon 6 at 0.5% solids and a pH of 1.5

Examples 13a–13x were performed the same as examples 12a–12x with the sole exception that half the amount of anionic polymer was added to the liquor so that it was applied at 0.5% by weight solids. The results of the tests are shown in Table 13. Comparing the results in Table 12 with the results in Table 13 shows that the reduced level of anionic binding polymer in examples 13a–13x produces better fluorochemical performance.

TABLE 13

| Ex. No. | Anionic Polymer | FC Used | AR 40 | Oil | Water | Water/ Alcohol | ppm F |
|---|---|---|---|---|---|---|---|
| 13a | FX369 | T232D | 3 | P | P | P | 161 |
| 13b | FX369 | FX1367F | 2 | P | P | P | 202 |
| 13c | FX668 | T232D | 4 | P | P | P | 110 |
| 13d | FX668 | FX1367F | 3–4 | P | P | P | 108 |
| 13e | FX661 | T232D | 2 | P | P | P | 117 |
| 13f | FX661 | FX1367F | 3–4 | P | P | P | 88 |
| 13g | FX657 | T232D | 1–2 | P | P | P | 160 |
| 13h | FX657 | FX1367F | 1–2 | P | P | P | 175 |
| 13i | SR300 | T232D | 1 | P | P | P | 164 |
| 13j | SR300 | FX1367F | 1 | P | P | P | 212 |
| 13k | LK1027 | T232D | 2–3 | F(M) | P | P | 126 |
| 13l | LK1027 | FX1367F | 1–2 | P | P(M) | F(M) | 183 |
| 13m | LK1028 | T232D | 4–5 | F | P | P(M) | 152 |
| 13n | LK1028 | FX1367F | 4–5 | P(M) | P(M) | F(M) | 162 |
| 13o | LK970 | T232D | 2 | F(M) | P | P(M) | 156 |
| 13p | LK970 | FX1367F | 1 | P | P(M) | F(M) | 197 |
| 13q | LK1084 | T232D | 1 | F | P | P(M) | 76 |
| 13r | LK1084 | FX1367F | 1 | P(M) | F | F | 172 |
| 13s | TS100 | T232D | 3–4 | F | F(M) | F | 42 |
| 13t | TS100 | FX1367F | 4 | F | F(M) | F | 60 |
| 13u | XP-4-49 | T232D | 3–4 | F | F(M) | F | 104 |
| 13v | XP-4-49 | FX1367F | 4 | F | F(M) | F | 201 |
| 13w | XP-4-50 | T232D | 4–5 | F | P | P(M) | 99 |
| 13x | XP-4-50 | FX1367F | 4–5 | P | P | P(M) | 238 |

EXAMPLES 14a–14x

Various Anionic Polymers Applied to Nylon 6 at 1.0% solids and a pH of 1.8

Examples 14a–14x were performed the same as examples 12a–12x with the sole exception that the pH of the bath was adjusted to 1.8. The results of the tests are shown in Table 14.

TABLE 14

| Ex. No. | Anionic Polymer | FC Used | AR 40 | Oil | Water | Water/ Alcohol | ppm F |
|---|---|---|---|---|---|---|---|
| 14a | FX369 | T232D | 5 | F | F | F | 39 |
| 14b | FX369 | FX1367F | 5 | F | F | F | 75 |
| 14c | FX668 | T232D | 5 | F | P | F(M) | 53 |
| 14d | FX668 | FX1367F | 5 | F | F | F | 58 |
| 14e | FX661 | T232D | 5 | F | P | F | 39 |
| 14f | FX661 | FX1367F | 5 | F | P(M) | F | 40 |
| 14g | FX657 | T232D | 5 | P | P | P | 168 |
| 14h | FX657 | FX1367F | 5 | P(M) | F(M) | F(M) | 130 |
| 14i | SR300 | T232D | 2–3 | P | P | P | 132 |
| 14j | SR300 | FX1367F | 4 | P | P | P(M) | 104 |
| 14k | LK1027 | T232D | 5 | F | P | P | 82 |
| 14l | LK1027 | FX1367F | 5 | P | P(M) | P(M) | 170 |
| 14m | LK1028 | T232D | 4–5 | F | P | P | 145 |
| 14n | LK1028 | FX1367F | 4–5 | F(M) | P(M) | F(M) | 194 |
| 14o | LK970 | T232D | 3 | F | P | F(M) | 136 |
| 14p | LK970 | FX1367F | 3 | F(M) | F(M) | F | 240 |
| 14q | LK1084 | T232D | 1–2 | F | F | F | 62 |
| 14r | LK1084 | FX1367F | 1–2 | P | F | F | 131 |
| 14s | TS100 | T232D | 3–4 | F | F | F | 39 |
| 14t | TS100 | FX1367F | 4–5 | F | F | F | 37 |
| 14u | XP-4-49 | T232D | 4–5 | F | P | F(M) | 127 |
| 14v | XP-4-49 | FX1367F | 4–5 | P | P | F(M) | 185 |
| 14w | XP-4-50 | T232D | 5 | F | P | P | 129 |
| 14x | XP-4-50 | FX1367F | 5 | P | P | P(M) | 177 |

EXAMPLES 15a–15x

Various Anionic Polymers Applied to Nylon 6 at 0.5% solids and a pH of 1.8

Examples 15a–15x were performed the same as examples 14a–14x with the sole exception that half the amount of anionic polymer was added to the liquor so that it was applied at 0.5% by weight solids. The results of the tests are shown in Table 15. Similar to the comparison of Tables 12 and 13, comparison of tables 14 and 15 show that the performance of the fluorochemical was improved with the reduced level of anionic binding polymer in examples 15a–x.

TABLE 15

| Ex. No. | Anionic Polymer | FC Used | AR 40 | Oil | Water | Water/ Alcohol | ppm F |
|---|---|---|---|---|---|---|---|
| 15a | FX369 | T232D | 3–4 | F | P | F(M) | 53 |
| 15b | FX369 | FX1367F | 2–3 | F | F(M) | F | 75 |
| 15c | FX668 | T232D | 3 | P | P(M) | P | 110 |
| 15d | FX668 | FX1367F | 3 | F(M) | P | P | 108 |
| 15e | FX661 | T232D | 2–3 | P | P | P | 117 |
| 15f | FX661 | FX1367F | 4–5 | P | F(M) | F(M) | 88 |
| 15g | FX657 | T232D | 3 | P | P | P | 160 |
| 15h | FX657 | FX1367F | 2 | P | P | P(M) | 175 |
| 15i | SR300 | T232D | 1 | P | P | P | 164 |
| 15j | SR300 | FX1367F | 1 | P | P | P | 212 |
| 15k | LK1027 | T232D | 2 | P(M) | P | P | 126 |
| 15l | LK1027 | FX1367F | 2 | P | P(M) | F(M) | 183 |
| 15m | LK1028 | T232D | 4–5 | F(M) | P | P(M) | 152 |
| 15n | LK1028 | FX1367F | 4–5 | P(M) | P(M) | F | 162 |
| 15o | LK970 | T232D | 2 | F | P | P | 156 |
| 15p | LK970 | FX1367F | 1 | P | P | P(M) | 197 |
| 15q | LK1084 | T232D | 1 | F | P | P(M) | 76 |
| 15r | LK1084 | FX1367F | 1 | P(M) | F(M) | F | 172 |
| 15s | TS100 | T232D | 3 | F | F | F | 42 |
| 15t | TS100 | FX1367F | 3–4 | F | F | F | 60 |
| 15u | XP-4-49 | T232D | 3–4 | F | P | F | 104 |
| 15v | XP-4-49 | FX1367F | 4 | F | F(M) | F | 201 |
| 15w | XP-4-50 | T232D | 5 | P | P | P(M) | 188 |
| 15x | XP-4-50 | FX1367F | 4–5 | P | P | P(M) | 93 |

EXAMPLES 16a–16x

Various Anionic Polymers Applied to Nylon 6,6 at 1.0% solids and a pH of 1.5

Examples 16a–16x were performed the same as examples 12a–12x with the sole exception that the carpet used was made from nylon 6,6 Superba set yarn tufted at 35 osy. The results of the tests are shown in Table 16. The results for these examples with nylon 6,6 are similar to those found in Table 12 for nylon 6.

TABLE 16

| Ex. No. | Anionic Polymer | FC Used | AR 40 | Oil | Water | Water/ Alc. | ppm F |
|---|---|---|---|---|---|---|---|
| 16a | FX369 | T232D | 5 | F | F | F | 37 |
| 16b | FX369 | FX1367F | 5 | F | F(M) | F | 70 |
| 16c | FX668 | T232D | 5 | F | F(M) | F | 52 |
| 16d | FX668 | FX1367F | 5 | F | F(M) | F | 44 |
| 16e | FX661 | T232D | 5 | F | P | F | 45 |
| 16f | FX661 | FX1367F | 5 | F | P(M) | F | 57 |
| 16g | FX657 | T232D | 5 | P | P | P | 154 |
| 16h | FX657 | FX1367F | 5 | P | P | P | 215 |
| 16i | SR300 | T232D | 5 | P | P | P | 135 |
| 16j | SR300 | FX1367F | 5 | P | P | P | 180 |
| 16k | LK1027 | T232D | 5 | F | P | P | 85 |
| 16l | LK1027 | FX1367F | 5 | F(M) | P | P | 187 |
| 16m | LK1028 | T232D | 4–5 | F | P | P(M) | 142 |
| 16n | LK1028 | FX1367F | 4–5 | F | F(M) | F(M) | 192 |
| 16o | LK970 | T232D | 4–5 | F | F(M) | F | 136 |
| 16p | LK970 | FX1367F | 4–5 | F | F(M) | F | 161 |
| 16q | LK1084 | T232D | 1–2 | F(M) | F | F | 72 |
| 16r | LK1084 | FX1367F | 1–2 | P(M) | F | F | 170 |
| 16s | TS100 | T232D | 4–5 | F | F | F | 51 |
| 16t | TS100 | FX1367F | 5 | F | F | F | 40 |
| 16u | XP-4-49 | T232D | 4–5 | F(M) | P(M) | F(M) | 128 |
| 16v | XP-4-49 | FX1367F | 4–5 | F(M) | P | F(M) | 166 |
| 16w | XP-4-50 | T232D | 5 | F(M) | P | P | 125 |
| 16x | XP-4-50 | FX1367F | 5 | P | P | P | 230 |

EXAMPLES 17a–17x

Various Anionic Polymers Applied to Nylon 6,6 at 0.5% solids and a pH of 1.5

Examples 17a–17x were performed the same as examples 16a–16x with the sole exception that half the amount of anionic polymer was added to the liquor so that it was applied at 0.5% by weight solids. The results of the tests are shown in Table 17.

Though not as dramatic as the comparison between Tables 12 and 13, the comparison of the results in Tables 16 and 17 shows that the performance of the fluorochemical is enhanced with the lower level of anionic binding polymer.

TABLE 17

| Ex. No. | Anionic Polymer | FC Used | AR 40 | Oil | Water | Water/ Alcohol | ppm F |
|---|---|---|---|---|---|---|---|
| 17a | FX369 | T232D | 5 | F | F(M) | F | 44 |
| 17b | FX369 | FX1367F | 5 | F | P(M) | F | 80 |
| 17c | FX668 | T232D | 5 | F | P | F(M) | 61 |
| 17d | FX668 | FX1367F | 5 | F | P(M) | F(M) | 97 |
| 17e | FX661 | T232D | 5 | F | P | F(M) | 68 |
| 17f | FX661 | FX1367F | 5 | F | F(M) | F | 80 |
| 17g | FX657 | T232D | 5 | P | P | P | 142 |
| 17h | FX657 | FX1367F | 5 | P | P | P(M) | 217 |
| 17i | SR300 | T232D | 3–4 | P | P | P | 151 |
| 17j | SR300 | FX1367F | 4–5 | P | P | P | 129 |
| 17k | LK1027 | T232D | 5 | F(M) | P | P(M) | 149 |
| 17l | LK1027 | FX1367F | 5 | P | P | F(M) | 224 |
| 17m | LK1028 | T232D | 4–5 | F(M) | P | P(M) | 140 |
| 17n | LK1028 | FX1367F | 4–5 | F(M) | P | F(M) | 189 |
| 17o | LK970 | T232D | 4–5 | F(M) | P | F | 133 |
| 17p | LK970 | FX1367F | 4–5 | F(M) | P(M) | F | 184 |
| 17q | LK1084 | T232D | 1 | F(M) | P | P | 109 |
| 17r | LK1084 | FX1367F | 1 | P(M) | F | F | 145 |
| 17s | TS100 | T232D | 4–5 | F | F(M) | F | 49 |
| 17t | TS100 | FX1367F | 4–5 | F | P | F | 60 |
| 17u | XP-4-49 | T232D | 4–5 | F | P | P | 79 |
| 17v | XP-4-49 | FX1367F | 4–5 | F | P | F(M) | 150 |
| 17w | XP-4-50 | T232D | 5 | F(M) | P | P | 104 |
| 17x | XP-4-50 | FX1367F | 5 | P | P | P | 247 |

EXAMPLES 18a–18x

Various Anionic Polymers Applied to Nylon 6,6 at 1.0% solids and a pH of 1.8

Examples 18a–18x were performed the same as examples 16a–16x with the sole exception that the pH of the bath was adjusted to 1.8. The results of the tests are shown in Table 18.

TABLE 18

| Ex. No. | Anionic Polymer | FC Used | AR 40 | Oil | Water | Water/ Alcohol | ppm F |
|---|---|---|---|---|---|---|---|
| 18a | FX369 | T232D | 5 | F | F | F | 50 |
| 18b | FX369 | FX1367F | 5 | F | F(M) | F | 59 |
| 18c | FX668 | T232D | 5 | F | F(M) | F | 70 |
| 18d | FX668 | FX1367F | 5 | F | F(M) | F | 56 |
| 18e | FX661 | T232D | 5 | F | P(M) | F | 32 |
| 18f | FX661 | FX1367F | 5 | F | P(M) | F | 34 |
| 18g | FX657 | T232D | 5 | P | P | P | 135 |
| 18h | FX657 | FX1367F | 5 | P(M) | F(M) | F(M) | 108 |
| 18i | SR300 | T232D | 5 | P | P | P | 147 |
| 18j | SR300 | FX1367F | 5 | F(M) | P | P(M) | 108 |
| 18k | LK1027 | T232D | 5 | F | P | P | 86 |
| 18l | LK1027 | FX1367F | 5 | P(M) | P | P | 178 |
| 18m | LK1028 | T232D | 4–5 | F | P | F(M) | 145 |
| 18n | LK1028 | FX1367F | 4–5 | F | P(M) | F(M) | 168 |
| 18o | LK970 | T232D | 4–5 | F | P(M) | F(M) | 151 |
| 18p | LK970 | FX1367F | 4–5 | F | F(M) | F | 259 |
| 18q | LK1084 | T232D | 1–2 | F(M) | F | F | 74 |
| 18r | LK1084 | FX1367F | 1–2 | P | F | F | 149 |
| 18s | TS100 | T232D | 5 | F | F | F | 28 |
| 18t | TS100 | FX1367F | 5 | F | F | F | 35 |
| 18u | XP-4-49 | T232D | 4–5 | F(M) | P | P | 148 |
| 18v | XP-4-49 | FX1367F | 4–5 | P | P | P(M) | 199 |
| 18w | XP-4-50 | T232D | 5 | F(M) | P | P | 118 |
| 18x | XP-4-50 | FX1367F | 5 | P | P | P(M) | 127 |

EXAMPLES 19a–19x

Various Anionic Polymers Applied to Nylon 6,6 at 0.5% solids and a pH of 1.8

Examples 19a–19x were performed the same as examples 18a–18x with the sole exception that half the amount of anionic polymer was added to the liquor so that it was applied at 0.5% by weight solids. The results of the tests are shown in Table 19. These results are similar to those for examples 18a–x. Thus, there was not a marked improvement in fluorochemical performance with the reduced level of anionic binding polymer.

TABLE 19

| Ex. No. | Anionic Polymer | FC Used | AR 40 | Oil | Water | Water/ Alcohol | ppm F |
|---|---|---|---|---|---|---|---|
| 19a | FX369 | T232D | 5 | F | F(M) | F | 41 |
| 19b | FX369 | FX1367F | 5 | F | F(M) | F | 55 |
| 19c | FX668 | T232D | 5 | F | P | F | 41 |
| 19d | FX668 | FX1367F | 5 | F | P(M) | F | 59 |
| 19e | FX661 | T232D | 5 | F | F(M) | F | 45 |
| 19f | FX661 | FX1367F | 5 | F | F | F | 48 |
| 19g | FX657 | T232D | 5 | P | P | P | 137 |
| 19h | FX657 | FX1367F | 5 | F(M) | P(M) | F(M) | 127 |
| 19i | SR300 | T232D | 4 | P | P | P | 142 |
| 19j | SR300 | FX1367F | 5 | P(M) | P | P(M) | 130 |
| 19k | LK1027 | T232D | 4–5 | F(M) | P | P(M) | 117 |
| 19l | LK1027 | FX1367F | 5 | F(M) | P(M) | F(M) | 214 |
| 19m | LK1028 | T232D | 4–5 | F(M) | P | P | 156 |
| 19n | LK1028 | FX1367F | 4–5 | P(M) | P | F(M) | 174 |
| 19o | LK970 | T232D | 4–5 | F | P | P(M) | 149 |
| 19p | LK970 | FX1367F | 3 | P | P | F | 172 |
| 19q | LK1084 | T232D | 1 | F(M) | P | P(M) | 97 |
| 19r | LK1084 | FX1367F | 1 | P(M) | P | F(M) | 173 |
| 19s | TS100 | T232D | 4–5 | F | F(M) | F | 33 |
| 19t | TS100 | FX1367F | 4–5 | F | P(M) | F | 41 |
| 19u | XP-4-49 | T232D | 4 | F(M) | P | P(M) | 87 |
| 19v | XP-4-49 | FX1367F | 4–5 | F | P(M) | F(M) | 201 |
| 19w | XP-4-50 | T232D | 5 | F(M) | P | P | 85 |
| 19x | XP-4-50 | FX1367F | 5 | P | P | P(M) | 188 |

The following generalizations can be made from a review of the data from examples 12–19. First, it appears that the Leukotan 1028 performed the best as the anionic binding/stain resist polymer on the different nylon fibers, at the different levels, and at the different pH levels. The XP-4-50 appears to have the second best performance, with the FX-657 the XP-4-49 and the Leukotan 970 coming in third, fourth and fifth place respectively.

EXAMPLES 20a–20q

Production Scale Tests

Examples 20a–20q were performed to demonstrate the invention on a production scale. These examples were also performed to compare the simultaneous application of fluorochemical and stain resist compound (Single Step Treatment or SST), with conventional application of the stain resist compound, if any, followed by the topical application by a spray bar of the fluorochemical, if any.

In the following examples, the carpet used was all made from either a DuPont Type 1150 nylon 6,6 filament yarn or a 1450 type polypropylene yarn. The nylon yarn was Superba heat set and tufted at 25.5 osy. The polypropylene yarn was also Superba heat set and tufted at 34.3 osy. The carpet included a latex adhesive coat and a polypropylene secondary backing both applied by conventional means. As is typical, the carpet was made in a roll about 12 feet wide.

This nylon carpet was dyed by conventional means. In particular, the carpet was passed through a continuous dye line with a wet pick-up of about 400 percent. The dye bath included an anionic surfactant and acid dyes to impart a putty beige color. The pH of the dye bath was 5.5. The carpet was steamed for 3.7 minutes and then rinsed with a wet pick-up of 500 percent and extracted to a wet pick-up of 40 percent.

In example 20a, the carpet was the nylon carpet referred to above. After the dyeing step, the carpet was passed through a flex nip applicator to apply both a fluorochemical and a stainblocker (SST). The bath included 0.142 percent solids of XP-4-50 and about 0.064 percent solids of FX1367F. The pH of this bath was 1.8. The wet pick-up was about 350 percent, thereby applying about 0.56 percent fluorochemical based on the weight of the carpet and about 3.42 percent stain resist compound based on the weight of the carpet. The carpet was steamed for 2.7 minutes and then rinsed with a wet pick-up of 500 percent and extracted to a wet pick-up of 40 percent.

The carpet was then dried in an oven set at 240° F. for 1.0 minutes.

Example 20b was the same as example 20a with the exception that only half as much FX1367F was present in the bath, namely a level of 0.032 percent solids.

Example 20c was the same as example 20a with the exception that NRD372 was used as the fluorochemical at 0.029 percent solids in the place of the FX1367F.

Example 20d was the same as example 20c with the exception that only half as much NRD372 was used, namely 0.014 percent solids.

Example 20e was the same as example 20a with the exception that T232D was used as the fluorochemical at a level of 0.010 percent solids.

Example 20f was the same as example 20e with the exception that the level of T232D in the treatment bath was increased to 0.021 percent solids.

Example 20g was the same as example 20e with the exception that the level of T232D in the treatment bath was increased to 0.043 percent solids.

Example 20h was the same as example 20a with the exception that there was no fluorochemical in the treatment bath. Instead, the treatment bath included only an anionic polymer/stain resistant composition, namely SR300 at 0.24 percent solids. The treatment bath had a pH of 2.2. After the rinse and extraction step described in example 20a, the FX1367F fluorochemical was applied by a spray bar (Spray)

which applied a wet pick-up of about 15 percent of an emulsion that contained 1.38 percent solids, resulting in an application of about 0.21 percent fluorochemical based on the weight of the carpet.

Example 20i was the same as example 20h with the exception that the FX1367F was present at 1.22 percent of the emulsion sprayed onto the carpet, thus providing 0.18 percent solids based on the weight of the carpet.

Example 20j was the same as example 20i with the exception that the DuPont fluorochemical NRD372 was applied by the spray bar in place of the FX 1367F. The level of NRD372 was 1.17 percent solids of the emulsion, resulting in an application of about 0.18 percent based on the weight of the carpet.

Example 20k was the same as example 20j with the exception that the level of NRD372 was lowered to 0.72 percent solids, resulting in an application of about 0.11 percent based on the weight of the carpet.

Example 20l was the same as example 20a with the exception that the polypropylene carpet was used in place of the nylon carpet. Also, the polypropylene carpet was not dyed, but rather treated with a solution containing only 0.105 percent anionic surfactant at a pH of 7.5. The carpet was steamed for 3.7 minutes before being rinsed and extracted as described above. In addition, the fluorochemical T232D was used in the treatment bath at a level of 0.015 percent solids. The level of XP-4-50 in the treatment bath was lowered to 0.137 percent solids.

Example 20m was the same as example 201 with the exception that the level of T232D in the treatment bath was increased to 0.030 percent solids.

Example 20n was the same as example 20m with the exception that no anionic polymer/stain resist compound was included in the treatment bath or applied to the carpet in any step.

Example 20o was the same as example 20n with the exception that instead of applying T232D fluorochemical in the treatment bath, FX1367F was applied through a spray bar. In particular, the carpet was subjected to the pre-treatment, but not immersed in a bath with either anionic binding polymer or fluorochemical, nor was the carpet subjected to the steaming step that would have taken place after that bath. An emulsion containing 1.06 percent solids FX1367F was sprayed on with a wet pick-up of 15 percent, thereby producing about 0.16 percent solids FX1367F based on the weight of the carpet.

The carpet produced in each of the examples was tested for fluorine content, oil, water, and water/alcohol repellency, the Acid Red #40 stain test, the WAQE stain resistance durability test, the Mustard stain test and the Coffee stain test. The results of these tests are reported in part A of Table 20. The carpet produced was also tested in the for Kappa soiling with the ΔL* being reported. The carpet was also tested for fluorochemical penetration, lightfastness when exposed to Ozone, NOx and Xenon light. The results of these tests are reported in part B of Table 20.

TABLE 20 part A

| Ex. No. | SST or Spray | ppm F | Oil | Water | Water/ Alc | AR 40 | WAQE Stain | Must. Stain | Coffee Stain |
|---|---|---|---|---|---|---|---|---|---|
| 20a | SST | 139 | P | F(M) | F | 5 | 3 | 2–3 | 4 |
| 20b | SST | 120 | P | F | F | 5 | 3 | 3 | 4 |
| 20c | SST | 185 | P | P | P(M) | 4–5 | 3 | 2–3 | 4 |
| 20d | SST | 133 | P | P | F(M) | 4–5 | 2–3 | 3 | 4–5 |
| 20e | SST | 149 | F(M) | P(M) | F(M) | 5 | 3–4 | 2–3 | 4–5 |
| 20f | SST | 312 | P | P | P | 5 | 3–4 | 3 | 4–5 |
| 20g | SST | 971 | P | P | P | 5 | 3–4 | 3 | 4 |
| 20h | Spray | 185 | P | P(M) | F(M) | 4 | 2–3 | 1–2 | 4 |
| 20i | Spray | 152 | P | P(M) | F(M) | 4 | 2–3 | 1–2 | 4 |
| 20j | Spray | 778 | P | P | P | 4 | 2–3 | 1–2 | 4 |
| 20k | Spray | 461 | P | P | P | 4 | 3 | 1–2 | 4 |
| 20l | SST | 197 | P | P | P | | | | |
| 20m | SST | 412 | P | P | P | | | | |
| 20n | SST | 242 | P | P | P | | | | |
| 20o | Spray | 292 | P | P | P | | | | |

part B

| Ex. No. | SST or Spray | KS ΔL* | FC Pen. | Ozone 2 cyc. | Ozone 5 cyc. | NOx 2 cyc. | 40 hrs Xenon |
|---|---|---|---|---|---|---|---|
| 20a | SST | −14.16 | 50% | 5 | 5 | 3–4 | 4 |
| 20b | SST | −14.60 | 30% | 5 | 4 | 3–4 | 4–5 |
| 20c | SST | −12.89 | 100% | 5 | 5 | 3–4 | 3–4 |
| 20d | SST | −13.15 | 60% | 5 | 5 | 3 | 4 |
| 20e | SST | −17.28 | 15% | | | | |
| 20f | SST | −16.60 | 80% | | | | |
| 20g | SST | −17.84 | 100% | | | | |
| 20h | Spray | −12.70 | 30% | 5 | 5 | 4 | 3–4 |
| 20i | Spray | −12.15 | 30% | | | | |
| 20j | Spray | −11.20 | 50% | 4–5 | 4–5 | 4 | 5 |
| 20k | Spray | −12.22 | 20% | 5 | 5 | 4 | 4–5 |

TABLE 20-continued

| | | | |
|---|---|---|---|
| 20l | SST | −10.67 | 25% |
| 20m | SST | −10.56 | 95% |
| 20n | SST | −11.69 | 10% |
| 20o | Spray | −11.67 | 30% |

It is thus seen that a novel, advantageous method of enhancing the repellency of carpet has been discovered. Preferably, the method also includes the simultaneous application of a compound to enhance the stain resistance of the carpet as well. As such, the invention provides a tremendous advantage in that the two treatments can be added simultaneously.

I claim:

1. A method of treating carpet yarn to enhance its repellency comprising the steps of:

providing carpet yarn comprising polymeric fibers;

providing effective repellency enhancing amounts of an anionic or nonionic fluorochemical compound and an anionic polymer binding compound in an aqueous medium, the aqueous medium having a pH below about 2.0;

immersing the carpet yarn in the aqueous medium; and removing excess water from the carpet.

2. The method of claim 1 wherein the binding compound increases the stain resistance of the carpet fibers.

3. The method of claim 1 wherein the pH is above about 1.0.

4. The method of claim 1 wherein the pH is between about 1.5 and about 1.8.

5. The method of claim 1 wherein the fluorochemical compound is selected from the group consisting of telomeric fluorochemicals and electrochemically fluorinated fluorochemicals.

6. The method of claim 1 wherein the fluorochemical compound is present in an amount between about 0.0035 and about 0.175 percent of the aqueous medium.

7. The method of claim 1 wherein the binding compound is present in an amount between about 0.05 and about 2.5 percent of the aqueous medium.

8. The method of claim 1 wherein the binding compound is a polymer or copolymer of methacrylic acid.

9. The method of claim 8 wherein the polymer or copolymer of methacrylic acid has a number average molecular weight between about 500 and about 20,000.

10. The method of claim 1 further comprising the step of applying heat to the carpet yarn after being removed from the aqueous medium to thereby fix the fluorochemical compound and the binding compound to the polymeric fibers.

11. The method of claim 10 wherein the carpet yarn is heated at a temperature between about 160° and about 260° F. for between about 15 seconds and about 60 minutes.

12. The method of claim 10 wherein the carpet yarn is heated at a temperature between about 180° and about 220° F. for between about 30 seconds and 8 minutes.

13. The method of claim 10 wherein the carpet yarn is heated with steam.

14. The method of claim 10 wherein the ratio of aqueous medium to carpet yarn during the heating step is at least 0.5:1.

15. The method of claim 10 wherein the ratio of aqueous medium to carpet yarn during the heating step is between about 2:1 and about 60:1.

16. The method of claim 1 wherein the carpet yarn tufted into a carpet which carpet is placed in a vessel containing the aqueous medium.

17. The method of claim 16 wherein the carpet is removed from the vessel before the heating step and the ratio of aqueous medium to carpet during the heating step is at least about 0.5:1.

18. The method of claim 17 wherein the ratio of aqueous medium to carpet during the heating step is between about 2:1 to about 10:1.

19. The method of claim 16 wherein the carpet and the aqueous medium are heated in the vessel.

20. The method of claim 19 wherein the ratio of aqueous medium to carpet during the heating step is between about 12:1 to about 60:1.

21. The method of claim 1 wherein the carpet yarn is tufted into a carpet which is pulled through a pool of the aqueous medium under conditions to produce a ratio of aqueous medium to carpet during the heating step of at least 0.5:1.

22. The method of claim 21 wherein the ratio of aqueous medium to carpet during the heating step is between about 2:1 to about 10:1.

23. The method of claim 22 wherein the carpet is immersed in the aqueous medium by use of a flex nip applicator.

24. The method of claim 1 wherein the carpet yarn is tufted into a carpet which is immersed in the aqueous medium by cascading the aqueous medium over the carpet so as to result in a ratio of aqueous medium to carpet of at least about 0.5:1 during the heating step.

25. The method of claim 1 wherein the fibers are made of a polyamide.

26. The method of claim 1 wherein the fibers are made of nylon and include acid dye sites, and wherein the binding compound blocks the acid dye sites to thereby make the nylon fibers stain resistant.

27. The method of claim 1 wherein the face fibers are made of polypropylene.

28. A method of treating carpet to enhance its repellency and stain resistance comprising the steps of:

providing a carpet comprising nylon face fibers;

providing effective repellency enhancing amounts of an anionic or nonionic fluorochemical compound and an anionic polymer stain resist compound in an aqueous medium, the aqueous medium having a pH below about 2.0;

immersing the carpet in the aqueous medium;

heating the carpet and aqueous medium; and removing excess water from the carpet.

29. The method of claim 28 wherein the pH is between about 1.5 and about 1.8.

30. The method of claim 28 wherein the fluorochemical compound is selected from the group consisting of telomeric fluorochemicals and electrochemically fluorinated fluorochemicals.

31. The method of claim 28 wherein the fluorochemical compound is a telomeric fluorochemical.

32. The method of claim 28 wherein the fluorochemical compound is present in an amount between about 0.0035 and about 0.175 percent of the aqueous medium.

33. The method of claim 28 wherein the carpet is heated at a temperature between about 180° and about 220° F. for between about 15 seconds and about 6 minutes.

34. The method of claim 28 wherein the carpet is heated with steam.

35. The method of claim 28 wherein the ratio of aqueous medium to carpet yarn during the heating step is at least 0.5:1.

36. The method of claim 28 wherein the ratio of aqueous medium to carpet during the heating step is between about 2:1 and about 60:1.

37. The method of claim 28 wherein the carpet is immersed in the aqueous medium by placing the carpet in a vessel containing the aqueous medium.

38. The method of claim 37 wherein the ratio of aqueous medium to carpet during the heating step is between about 2:1 to about 10:1.

39. The method of claim 38 wherein the carpet and the aqueous medium are heated in the vessel.

40. The method of claim 28 wherein the carpet is immersed in the aqueous medium by pulling a long roll of the carpet through a pool of the aqueous medium under conditions to produce a ratio of aqueous medium to carpet during the heating step of at least 0.5:1.

41. The method of claim 40 wherein the ratio of aqueous medium to carpet during the heating step is between about 2:1 to about 10:1.

42. The method of claim 40 wherein the carpet is immersed in the aqueous medium by use of a flex nip applicator.

43. The method of claim 28 wherein the polyamide is nylon 6.

44. A method of treating polypropylene carpet to enhance its repellency comprising the steps of:

providing a carpet comprising polypropylene face fibers;

providing effective repellency enhancing amounts of an anionic or nonionic fluorochemical compound and an anionic polymer binding compound in an aqueous medium, the aqueous medium having a pH below about 3.5;

immersing the carpet in the aqueous medium;

heating the carpet and aqueous medium; and removing excess water from the carpet.

45. The method of claim 44 wherein the pH is above about 1.0 and below about 3.5.

46. The method of claim 45 wherein the pH is between about 1.5 and about 1.8.

47. The method of claim 44 wherein the fluorochemical compound is selected from the group consisting of telomeric fluorochemicals and electrochemically fluorinated fluorochemicals.

48. The method of claim 44 wherein the fluorochemical compound is a telomeric fluorochemical.

49. The method of claim 44 wherein the fluorochemical compound is present in an amount between about 0.0035 and about 0.175 percent of the aqueous medium.

50. The method of claim 44 wherein the carpet is heated at a temperature between about 180° and about 220° F. for between about 15 seconds and about 6 minutes.

51. The method of claim 44 wherein the carpet is heated with steam.

52. The method of claim 44 wherein the ratio of aqueous medium to carpet yarn during the heating step is at least 0.5:1.

53. The method of claim 44 wherein the ratio of aqueous medium to carpet during the heating step is between about 2:1 and about 60:1.

54. The method of claim 44 wherein the carpet is immersed in the aqueous medium by placing the carpet in a vessel containing the aqueous medium.

55. The method of claim 54 wherein the carpet is removed from the vessel before the heating step and the ratio of aqueous medium to carpet is at least about 0.5:1.

56. The method of claim 55 wherein the ratio of aqueous medium to carpet during the heating step is between about 2:1 to about 10:1.

57. The method of claim 54 wherein the carpet and the aqueous medium are heated in the vessel.

58. The method of claim 44 wherein the carpet is immersed in the aqueous medium by pulling a long roll of the carpet through a pool of the aqueous medium under conditions to produce a ratio of aqueous medium to carpet during the heating step of at least 0.5:1.

59. The method of claim 58 wherein the ratio of aqueous medium to carpet during the heating step is between about 2:1 to about 10:1.

60. The method of claim 58 wherein the carpet is immersed in the aqueous medium by use of a flex nip applicator.

61. The method of claim 44 wherein the carpet is immersed in the aqueous medium by cascading the aqueous medium over the carpet so as to result in a ratio of aqueous medium to carpet of at least about 0.5:1 during the heating step.

62. A composition for treating carpet to enhance its repellency comprising effective repellency enhancing amounts of:

an aqueous medium;

an anionic or nonionic fluorochemical;

an anionic polymer binding compound;

wherein said aqueous medium has a pH below about 2.0.

63. The composition of claim 62 wherein the fluorochemical compound is present in an amount between about 0.0035 and about 0.175 percent.

64. The composition of claim 62 wherein the anionic polymer binding compound is present in an amount between about 0.01 and about 2.5 percent.

65. The composition of claim 62 having a pH of between about 1.5 and about 1.8.

66. The composition of claim 62 wherein the anionic polymer binding compound is a polymer or copolymer of methacrylic acid.

67. The composition of claim 62 wherein the fluorochemical is selected from the group consisting of telomeric fluorochemicals and electrochemically fluorinated fluorochemicals.

* * * * *